US005357323A

United States Patent [19]

Haneda et al.

[11] Patent Number: 5,357,323

[45] Date of Patent: Oct. 18, 1994

[54] MAGNETIC BRUSH CHARGING DEVICE

[75] Inventors: Satoshi Haneda; Kunio Shigeta; Sachie Hosokoezawa; Masakazu Fukuchi; Shizuo Morita; Hiroyuki Nomori, all of Hachioji, Japan

[73] Assignee: Konica Corporation, Tokyo, Japan

[21] Appl. No.: 138,411

[22] Filed: Oct. 15, 1993

[30] Foreign Application Priority Data

Oct. 26, 1992 [JP] Japan ..... 4-287715
Oct. 26, 1992 [JP] Japan ..... 4-287716
Nov. 12, 1992 [JP] Japan ..... 4-302486

[51] Int. Cl.[5] ..... G03G 15/02
[52] U.S. Cl. ..... 355/219; 361/225
[58] Field of Search ..... 355/219; 361/221, 225, 361/230

[56] References Cited

U.S. PATENT DOCUMENTS 4,174,903 11/1979 Snelling ..... 355/219

FOREIGN PATENT DOCUMENTS

0474220A3 3/1992 European Pat. Off. .
63-187267 8/1988 Japan ..... 355/219
4-21873 1/1992 Japan .
4-116674 4/1992 Japan .
5-100545 4/1993 Japan ..... 355/219
5-127490 5/1993 Japan ..... 355/219
5-134517 5/1993 Japan ..... 355/219

OTHER PUBLICATIONS

European Search Report.

*Primary Examiner*—A. T. Grimley
*Assistant Examiner*—William J. Royer
*Attorney, Agent, or Firm*—Frishauf, Holtz, Goodman & Woodward

[57] ABSTRACT

An image forming machine such as a copier or a printer for developing a latent image on a photoreceptor with toner. The image forming machine includes a sleeve for charging the photoreceptor; magnetic particles for forming a magnetic brush on a surface of the sleeve; a driver for driving the sleeve so that the magnetic brush is moved; and a power applying circuit for applying an alternating current between 20 and 500 μA/cm on to a charging area between the sleeve and the photoreceptor; in which the sleeve is located in the vicinity of the photoreceptor so that the magnetic brush is in contact with the surface of the photoreceptor.

9 Claims, 7 Drawing Sheets

MAGNETIC BRUSH CHARGING DEVICE

BACKGROUND OF THE INVENTION

The present invention relates to an image forming apparatus such as an electrophotographic copying machine and an electrostatic recording apparatus in which an electrostatic transfer process is used to form an image when a photoreceptor is charged.

In order to charge a photoreceptor such as a photoreceptor drum, a corona charger has been generally used hitherto, wherein high voltage is impressed upon a discharge wire and thereby a strong electric field is generated around the discharge wire for gaseous discharge. The photoreceptor is charged when electric charge ions generated in the course of gaseous discharge are adsorbed onto the surface of the photoreceptor.

A corona charger used in the conventional image forming apparatus mentioned above has an advantage that a photoreceptor is not damaged in the course of charging thereon because the charger does not come into mechanical contact with the photoreceptor. The corona charger, however, has a disadvantage, due to high voltage used therein, that there is a risk of an electric shock or electric leakage and also ozone generated in the course of gaseous discharge is harmful to human bodies and the ozone shortens the life of a photoreceptor. Further, charging voltage by means of a corona charger is sharply influenced by temperature and humidity to be unstable, and noise is caused by high voltage in the corona charger, which is a serious disadvantage on the occasion where an electrophotographic image forming apparatus is utilized as a terminal equipment for communication or an information processing apparatus.

These many disadvantages of a corona charger are caused by gaseous discharge necessary for charging.

Therefore, there are disclosed in Japanese Patent Publication Open to Public Inspection Nos. 133569/1984, 21873/1992 and 116674/1992 (hereinafter referred to as Japanese Patent O.P.I. Publication) the charging devices wherein magnetic particles are adsorbed on a cylindrical conveying carrier which is a charging roller holding therein magnetic objects for forming a magnetic brush, and the magnetic brush rubs the surface of the photoreceptor for charging it, as a charging device capable of charging the photoreceptor without conducting high voltage gaseous discharge carried out in a corona discharge and without giving any mechanical damages on the photoreceptor.

However, the charging devices disclosed in the patents described above have several problems. That is, according to the charging devices, it is impossible to charge a photoreceptor stably and uniformly. To be in more detail, in a transfer region, the magnetic particles on the surface of the cylindrical magnetic particle conveying carrier are formed chain-like along the lines of magnetic force, and charging is performed through these chain-like magnetic particles, however, unless the condition of magnetic particles in the transfer region is stable, charging is not uniformly performed, and dielectric breakdown of the photoreceptor occurs, and uneven charging is conducted. Further, discharge is caused between the magnetic particle chains forming the magnetic brush, so that ozone is generated. Further, when the charging operations are conducted over a long period of time, the magnetic particles are deteriorated. Therefore, after a certain period of time has passed, the charging condition is different from that in the initial copying stage.

In a magnetic brush charging operation, when a magnetic pole of the magnet 23 is arranged at a position where the magnetic pole is opposed to the photoreceptor 10, magnetic particle chains 121 are formed as shown in FIG. 5, and the photoreceptor 10 coming into contact with the magnetic particles is charged through these chains. When these magnetic particle chains are locally contacted with the photoreceptor 10, the contact portions are over-charged, and dielectric breakdown is caused in the photoreceptor, and uneven charging is caused.

As shown in FIG. 6, in a charging device of the prior art, a charging region is set up at a position where the charging roller 22, which is a rotational member to convey the magnetic particles 21, and the photoreceptor drum 10, which is a photoreceptor, are most closely located, and a magnetic pole 23*a* of the magnet 23 is provided at a position opposed to the aforementioned position where the charging roller 22 and the photoreceptor drum 10 are most closely located. The magnetic particles 21 in the charging region are connected along the lines of magnetic force of the magnet 23 so that they are formed into a chain-shape. In this way, bristles 21A of the magnetic brush are formed. When a bias voltage is impressed between the photoreceptor drum 10 and the charging roller 22, the photoreceptor drum 10 is charged through the conductive bristles 21A of the magnetic brush. As shown by small arrow marks in FIG. 6, electrical discharge occurs in the magnetic brush and between the chains of the magnetic particles 21, so that ozone is generated. When the magnetic particles 21 are used over a long period of time, they are deteriorated, and especially in the initial stage of a copy operation, the electrical resistance of the magnetic particles 21 is lowered, so that the electrical discharge is further facilitated.

As shown in FIG. 7, in the case where an amount of the magnetic particles 21 is small, the bristles 21A of the magnetic brush becomes rough. Therefore, the bristles 21A are not uniformly contacted with the surface of the photoreceptor 10. As a result, the photoreceptor 10 is locally overcharged, which causes dielectric breakdown of the photoreceptor drum 10 which is a photoreceptor, and further uneven charge occurs. In the case where an amount of the magnetic particles 21 is too much, the magnetic particles 21 are deposited on the surface of the photoreceptor drum 10, so that the charging region is unnecessarily extended, and further the electrical resistance of the bristles 21A is unnecessarily lowered and an over-current is caused. Further, the magnetic particles are not sufficiently oscillated, which causes uneven charging.

It is an object of the present invention to solve the problems described above and to provide an image forming apparatus in which dielectric breakdown of a photoreceptor can be avoided and generation of ozone can be prevented.

SUMMARY OF THE INVENTION

The above object can be accomplished by an image forming apparatus of the first example of the present invention in which magnetic particles are supplied to a rotating charging roller so as to form a magnetic brush, an alternating electrical field is applied to the magnetic brush formed on the charging roller, and the magnetic brush is contacted with a photoreceptor so as to electrically charge it, wherein the image forming apparatus is characterized in that: an A.C. current $I_{AC}$ of the bias impressed upon the charging area on the charging roller is 20 to 500 μA/cm; and magnetic particles, the amount W of which is 10 to 500 mg/cm$^2$, exist in the charging area. The charging area is the substantial area, to be charged by the charging roller, which is a little longer than the contacting length L of the magnetic brush to the photoreceptor.

It is preferable that a gap D (cm) formed between the charging roller and the photoreceptor is $300 \leqq W/D \leqq 3000$ (mg/cm$^3$).

The above object can be accomplished by an image forming apparatus of the second example of the present invention in which magnetic particles are supplied to a rotating charging roller so as to form a magnetic brush, an alternating electrical field is applied to the magnetic brush formed on the charging roller, and the magnetic brush is contacted with a photoreceptor so as to charge it, wherein the image forming apparatus is characterized in that: an A.C. current $I_{AC}$ of the bias impressed upon the charging area on the charging roller is 20 to 500 μA/cm; and a contacting length L (cm) of the magnetic brush in a contacting section is $0.2 \text{ cm} \leqq L \leqq 1$ cm. In the above image forming apparatus, it is preferable that a gap D (cm) formed between the charging roller and the photoreceptor is $1 \leqq L/D < 10$.

Further, the above object can be accomplished by an image forming apparatus of the third example of the present invention in which magnetic particles are supplied to a rotating member so as to form a magnetic brush, an alternating electrical field is applied to the magnetic brush formed on the rotating member, and the magnetic brush is contacted with a photoreceptor so as to charge it, wherein the image forming apparatus is characterized in that: an A.C. component current $I_{AC}$ of the bias voltage impressed in the charging region on the rotating member is 20 to 500 μA/cm; and a relative volume ratio Q (%) of the magnetic particles in the charging area of the magnetic brush is $20 \leqq Q \leqq 40\%$.

It is preferable that the following inequality is satisfied:

$$0.4 \leqq Q \times D \leqq 20 \text{ (cm)}$$

where a gap formed between the rotating member and the photoreceptor is D (cm), and the relative volume ratio is Q.

DETAILED DESCRIPTION OF THE PREFERRED EMBODIMENTS

Figure 1:
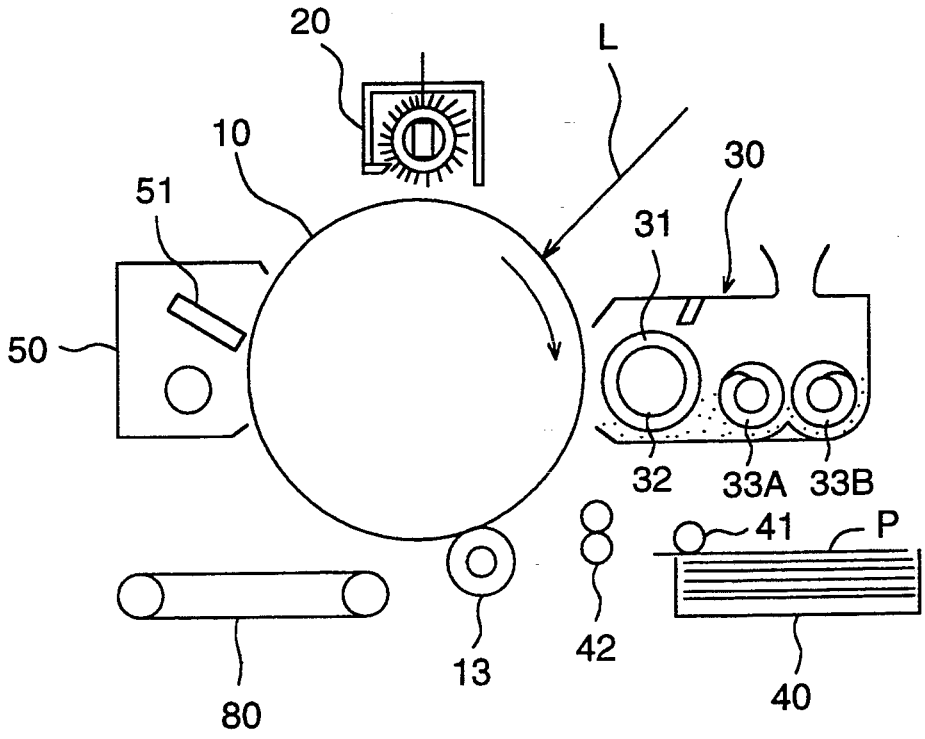
FIG. 1 is a sectional view showing an overall arrangement of the image forming apparatus of the present invention.

The particle size of magnetic particles and the condition of a charging roller of the first example of the present invention will be explained as follows.

Generally, when an average particle size weighted mean of magnetic particles is large, a magnetic brush formed on a charging roller shows its coarse structure. Therefore, even when charging while giving vibration with an electric field, the magnetic brush tends to show unevenness, resulting in a problem of uneven charging. In order to solve the problem, an average particle size of magnetic particles is required to be small, and results of experiments have shown that the average particle size of not more than 150 μm starts indicating its effect, and that of not more than 100 μm does not cause the problem mentioned above substantially. However, when particles are too small, they stick to the surface of a photoreceptor during the course of charging, or they easily scatter. These phenomena are observed remarkably in general when an average particle size is not more than 30 μm, though the phenomena depends on the intensity of a magnetic field, or the intensity of magnetization of particles caused by the magnetic field.

Due to the foregoing, it is preferable that the average particle size is not more than 150 μm, and it is more preferable that the average particle size is not more than 100 μm and not less than 30 μm. It is preferable that the intensity of magnetization of magnetic particles is 20 to 200 emu/g.

The magnetic particles as those mentioned above are obtained by selecting particle sizes through the average particle size selecting means known widely in the past from the particles of ferromagnetic substance such as metal including iron, chromium, nickel or cobalt identical to those in magnetic carrier particles in the conventional two-component developer, or such as a compound or an alloy thereof including, for example, triiron tetroxide, r-ferric oxide, chromium dioxide, manganese oxide, ferrite, or manganese-copper alloy, or from the particles obtained either by covering the surface of the ferromagnetic substance particle mentioned above with resins such as styrene resin, vinyl resin, ethylene resin, rosin-denatured resin, acrylic resin, polyamide resin, repoxy resin or polyester resin, or by preparing with resins containing dispersed magnetic substance fine particles.

A magnetic particle formed to be spherical offers an effect that a uniform particle layer can be formed on a charging roller and high bias voltage can be impressed uniformly on the charging roller. Namely, the magnetic particle formed to be spherical offers the following two effects: (1) though a magnetic particle tends to be adsorbed magnetically in its major axis direction, the spherical particle does not have any tendency in terms of direction of magnetic adsorption, and thereby a layer can be formed uniformly and occurrence of an area where the resistance is locally lower and unevenness of the layer thickness can be prevented, and (2) resistance of a magnetic particle is enhanced and the particle loses its edge portion observed on a conventional particle, thereby electric fields are not concentrated on the edge portion, resulting in uniform discharging on a photoreceptor and no occurrence of uneven charging despite impression of high bias voltage on a magnetic particle charging roller.

As the spherical particles exhibiting the effects mentioned above, those wherein conductive magnetic particles are formed so that electrical resistivity may show the value of not less than $10^3\Omega\cdot$cm and not more than $10^{12}\Omega\cdot$cm, especially the value of not less than $10^4\Omega\cdot$cm and not more than $10^9\Omega\cdot$cm are preferable. This electrical resistivity represents a value obtained by reading a value of an electric current when particles are put in a container having a cross-sectional area of 0.50 $cm^2$, then are tapped, load of 1 $kg/cm^2$ is applied on the crammed particles and voltage is impressed between the load and an electrode on the bottom of the container so that an electric field of 1,000 V/cm may be formed. Under the condition of low electrical resistivity, when bias voltage is impressed on a charging roller, electric charges are injected in magnetic particles and thereby the magnetic particles tend to stick to the charging roller, or dielectric breakdown of a photoreceptor caused by bias voltage tends to take place. When the electrical resistivity is high, on the contrary, no electric charges are injected and no charging is made accordingly.

With regard to magnetic particles used in the first example, the preferable ones have small specific gravity and appropriate maximum magnetization so that a magnetic brush composed of the magnetic particles may move lightly owing to an alternating electric field and yet no scattering of the magnetic particles may occur. It has been found out that the magnetic particles whose true specific gravity is not more than 6 and maximum magnetization is 30–100 emu/g produce good results actually.

Putting the foregoing together, optimum conditions of the magnetic particles include that a particle is made globular so that the ratio of the major axis to the minor axis of the particle is not more than 3, a needle like portion and an edge portion of the particle have no protrusions and electrical resistivity is preferably not less than $10^4\Omega\cdot$cm and not more than $10^9\Omega\cdot$cm. The magnetic particles having the optimum conditions mentioned above can be manufactured by selecting the spherical particles to the utmost, and by providing a spheroidizing process after formation of dispersed resin particles by using magnetic substance fine particles to the utmost in the case of particles wherein magnetic substance fine particles are dispersed, or by forming dispersed resin particles through the method of spray drying.

Further, when toner is mixed in a magnetic brush, charging efficiency is lowered and thereby uneven charging takes place because insulating power of the toner is high. For avoiding this problem, it is necessary to reduce an amount of charges on the toner so that the toner may move to a photoreceptor in the course of charging. It was possible to prevent toner accumulation on a magnetic brush when an amount of frictional electrification of toner was made to be 1–20 $\mu C/g$ in the same charging polarity under the condition that toner was mixed with magnetic particles and adjusted to the toner concentration of 1%. It is considered that the reason for the above is that the toner, even when it is mixed, sticks to a photoreceptor in the course of charging. It was confirmed that when an amount of charges of toner is large, it is difficult for the toner to leave magnetic particles, while when that is small, it is difficult to move electrically to a photoreceptor.

The foregoing represents the conditions of magnetic particles, and conditions of magnetic particles forming a particle layer and thereby charging a photoreceptor in relation to a charging roller will be explained as follows.

With regard to a charging roller for magnetic particles, a conductive charging roller capable of being impressed with a bias voltage is used, and especially, the one wherein a magnetic object having plural magnetic poles is provided inside a conductive charging roller having on its surface a particle layer, is preferably used. In such a charging roller as mentioned above, fresh magnetic particles are supplied in succession because a particle layer formed on the surface of the conductive charging roller due to the relative rotation to the magnetic object moves with a wavy movement, and even when slight unevenness in thickness of a layer exists in a particle layer on the surface of the charging roller, the effect of the unevenness can be offset sufficiently by the wavy movement mentioned above so that no problem may be caused practically. The conveyance speed for magnetic particles caused by a rotation of the charging roller may be slower than the moving speed of a photoreceptor, but it is preferable that the conveyance speed is either equivalent mostly to or higher than the moving speed of a photoreceptor. With regard to the conveyance direction caused by a rotation of the charging carrier, the same direction is preferable. The uniform charging under the condition of the same direction is superior to that under the condition of the opposite direction. However, the present invention is not limited to the specific example.

It is preferable that a particle layer formed on the charging roller is sufficiently scraped by a regulating plate and the thickness of the particle layer becomes uniform. When an amount of magnetic particles existing in a charging area on the surface of the charging roller is large, the magnetic particles can not be vibrated sufficiently, causing abrasion of a photoreceptor and uneven charging, and excess current tends to flow while the torque for driving the charging roller is increased, which is a disadvantage. When an amount of magnetic particles existing in a charging area on the surface of the charging roller is small, on the contrary, a portion of imperfect contact with a photoreceptor is created, causing magnetic particles to stick to the photoreceptor and uneven charging to take place. It was found, after some experiments, that the preferable amount W of magnetic particles existing in the charging area is 10–500 $mg/cm^2$ and the more preferable amount is 10–300 $mg/cm^2$. Also, it was found that the most preferable amount is 30–150 $mg/cm^2$. The aforementioned existence amount is an average value in the contacting area of the magnetic brush. When the existence amount W was smaller than 10 $mg/cm^2$, charging was not uniformly conducted, and magnetic particles were deposited. In the case of $W > 300$ $mg/cm^2$, the A.C. current $I_{AC}$ flowing in the unit length of charging area of the conveyance carrier was increased, so that an amount of ozone generation was increased. In the case of $W \geqq 500$ $mg/cm^2$, the charging area was clogged with the magnetic particles, so that abrasion of the photoreceptor was caused and conveyance was not performed properly, and good results were not provided.

The distance between a charging roller and a photoreceptor which is 100–5000 $\mu m$ is preferable. When the distance between a charging roller and a photoreceptor is smaller than 100 $\mu m$, it is difficult to form an ear of a magnetic brush that conducts uniform charging operation for the distance, and it is impossible to supply sufficient magnetic particles to the charging area, making it impossible to charge stably. When the distance D exceeds 5000 μm by far, a particle layer is formed coarsely, causing uneven charging to take place easily and causing sufficient charging not to be obtained by reducing the charge injection efficiency. When the distance between a charging roller and a photoreceptor takes an extreme value as shown above, the thickness of a particle layer on the charging roller can not be adjusted to the appropriate value for the distance. When the distance is in the range of 100–5000 μm, however, it is possible to make the thickness of a particle layer to be appropriate for the distance so that occurrence of comet caused by rubbing of a magnetic brush may be prevented. It was further clarified that most preferable conditions exist between the appropriate conveyance amount (W) and distance (D).

Conditions of $300 \leqq W/D \leqq 3{,}000$ (mg/cm$^3$) were important for charging uniformly, at high speed and stably. When the value of W/D was out of this range, it was confirmed that uneven charging took place.

D is considered to be a factor for determining the length of a chain of magnetic particles. Electric resistance corresponding to the length of the chain is considered to correspond to easiness of charging and charging speed. On the other hand, W is considered to be a factor determining the density of chains of magnetic particles. It is considered that an increase of the number of chains improves uniformity of charging. In a charging area, however, it is considered that compressed state of chains of magnetic particles is realized when the magnetic particles pass through a narrow gap. In this case, the chains of magnetic particles rub a photoreceptor while the chains contact each other to be bent and disturbed.

The disturbing conditions are considered to cause no charging streaks and to make the movement of charges easy, thereby to be effective for uniform charging. Namely, when the value of W/D corresponding to magnetic particles density is small, chains of magnetic particles are coarse to receive less disturbance, resulting in uneven charging. When the value of W/D is large, chains of magnetic particles are not formed sufficiently due to the high degree of packing, and magnetic particles are less disturbed. This prevents the free movement of charges and is considered to be the reason for uneven charging.

In the case of an image forming method in which the aforementioned charging device is used as a cleaning device, it is preferable to employ reversal development compared with normal development, because toner can be easily discharged from the charging device, and the polarity of the discharged toner becomes the same in the case of reversal development, and when the toner is recovered by the action of development bias voltage, the occurrence of fog in an image can be prevented.

In the charging device of the first example, a bias voltage is impressed upon the grounded photoreceptor by the charging roller through the magnetic brush. The bias voltage to be impressed is an A.C. bias voltage in which an A.C. current component is superimposed on a D.C. current component, the value of which is approximately the same as that of a voltage to be charged on the image forming object. This A.C. bias voltage is different, and depends on the gap D formed between the charging roller and the photoreceptor, and further depends on the charging voltage to be charged on the photoreceptor. A preferable charging condition is as follows: an A.C. bias voltage, the peak-to-peak voltage ($V_{p-p}$) is 200 to 3500 V is superimposed on a D.C. component, the polarity of which is the same as that of the voltage to be charged, and the voltage of which is 500 to 1000 V. In this connection, in the magnetic brush charging process, the electrical resistance of the magnetic particles fluctuates when they are used over a long period of time, and further the electrical resistance of the magnetic particles fluctuates when toner particles adhere to them. Further, when the impressed voltage is high, discharge takes place in the chains of the magnetic brush, so that ozone is generated.

In this case, the A.C. component to be impressed has a function to facilitate the injection of electrical charge conducted by the D.C. component. However, when this function is excessively facilitated, an amount of generated ozone is increased. The inventors made many experiments and found that the A.C. voltage component was appropriately impressed by means of constant current control. The inventors also found that the A.C. current $I_{AC}$ per a unit charging width was required to be in a range of 20–500 μA/cm. In this case, the A.C. current $I_{AC}$ is an A.C. current that flows in a unit width and in the axis direction of the charging roller which is a charging roller. In the case of $I_{AC} < 20$ μA/cm, charging can not be uniformly performed, and in the case of $I_{AC} > 500$ μA/cm, an amount of generated ozone is suddenly increased, so that the deterioration of magnetic particles is facilitated.

From the foregoing, preferable conditions are as follows: a magnetic brush composed of a layer of magnetic particles sticking to a charging roller for magnetic particles having magnetic force is brought into contact with a moving photoreceptor, a bias electric field is formed between the charging roller and the photoreceptor, and thereby an alternating electric field is used for the bias electric field under the condition that the A.C. current $I_{AC}$ controlled to be 20 to 500 μA/cm is superimposed on the D.C. component, the magnetic brush is formed so that an existing amount of magnetic particles at a charging area may be 10–500 mg/cm$^2$ and further the conditions of $300 \leqq W/D \leqq 3{,}000$ (mg/cm$^3$) wherein D (cm) represents the distance between the charging roller for magnetic particles and the photoreceptor are satisfied, in a charging device for charging a photoreceptor. Due to the foregoing, magnetic brush density necessary for appropriate charging can be maintained.

The first example of the invention will be explained as follows, referring to the attached drawings.

FIG. 1 is a sectional view showing the outline of the structure of an electrostatic recording apparatus that is an image forming apparatus of the invention. In the figure, the numeral 10 represents a photoreceptor that rotates in the arrowed direction (clockwise), namely a photoreceptor drum composed of OPC charged negatively. Around the circumference surface of the photoreceptor drum, there are provided charging device 20 which will be described later, an exposure unit where image light L from an exposure device enters, developing unit 30, transfer roller 13 and cleaning unit 50.

In the basic operation of a copy process of the present example, when a command to start copying is sent from an unillustrated operation panel to an unillustrated control unit, photoreceptor drum 10 starts rotating in the arrowed direction, being controlled by the control unit. When the photoreceptor drum 10 rotates, the circumference surface thereof passes through charging device 20 described later to be charged uniformly. On the surface of the photoreceptor drum 10, there is written an image with image light L, such as a laser beam, for example, from an image writing device, thus, an electrostatic latent image corresponding to the image is formed.

In developing unit 30, there are contained two-component developers which are stirred by stirring screws 33A and 33B and then adhere to the external surface of developing sleeve 31 which is positioned to cover magnetic object roller 32 and rotates to form a magnetic brush of developers. On the developing sleeve 31, there is impressed predetermined bias voltage so that reversal development may be conducted at the developing area facing the photoreceptor drum 10.

Recording sheets P are fed out from sheet-feeding cassette 40 by first sheet-feeding roller 41 one sheet by one sheet. The recording sheet P thus fed out is sent onto photoreceptor drum 10 by second sheet-feeding roller 42 that operates in synchronization with the aforementioned toner image on the photoreceptor drum 10. Then, the toner image on the photoreceptor drum 10 is separated from the photoreceptor drum 10 and transferred onto the recording sheet P through the operation of transfer roller 13. The recording sheet P onto which the toner image has been transferred is sent through conveyance means 80, to an unillustrated fixing unit where the recording sheet is sandwiched between a heat-fixing roller and a pressure roller to be fixed, and then is ejected to the outside of an apparatus. The surface of the photoreceptor drum 10 having thereon toner which stays there without being transferred onto the recording sheet P is scraped by cleaning unit 50 equipped with blade 51 or the like for cleaning to be standing by being ready for the following copying.

Figure 2:
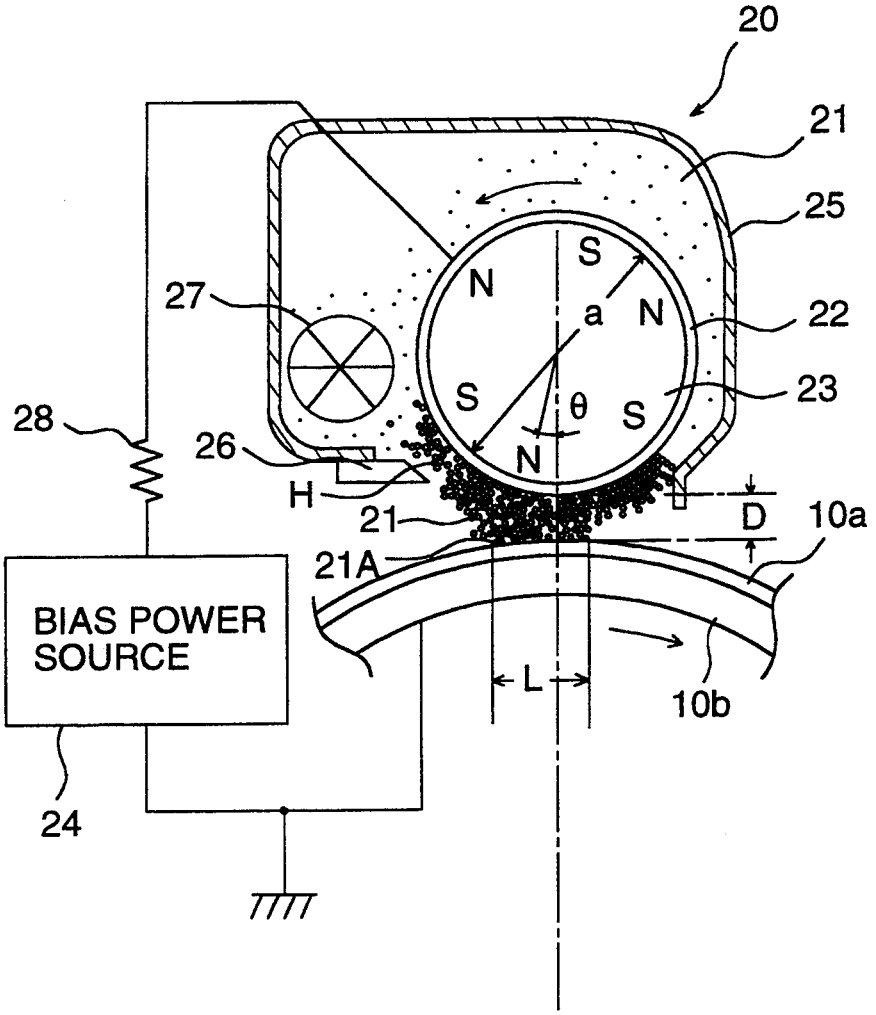
FIG. 2 is a sectional view showing an example of the charging device shown in FIG. 1.

FIG. 2 represents a sectional view showing an example of charging device 20 used for the image forming apparatus in FIG. 1. In the figure, the numeral 21 represents magnetic particles. In this example, spherical ferrite particles coated with a conductive substance were used for the magnetic particles 21. Alternatively, conductive magnetic resin particles may be used, which are provided in the following manner: after magnetic particles and resin have been thermally kneaded and solidified, it is smashed to small particles so as to provide conductive magnetic resin particles. In order to provide excellent charging, the magnetic particles must be perfectly spherical, and the particle size must be 50 $\mu$m, and specific resistance must be $10^8\Omega\cdot$cm, and further the triboelectrical charging amount with respect to toner is $-5$ $\mu$C/g when toner concentration is 1%. Numeral 22 represents a charging roller that is a carrier for conveying magnetic particles 21 formed with non-magnetic and conductive metal such as, for example, aluminum, and 23 represents a columnar magnetic object affixed inside the charging roller 22. Around the circumference of the columnar magnetic object 23, there are arranged south poles and north poles as shown in the figure so that the surface of the charging roller 22 may show 500–1,000 gauss, and thereby the columnar magnetic object is magnetized.

The diameter of the charging roller 22 is 5 to 30 mm$\phi$, and the charging roller 22 can be rotated with respect to the magnet 23. A gap formed between the charging roller 22 and the photoreceptor drum 10 is maintained at 0.5 to 1.0 mm. The charging roller 22 is rotated in the same direction as that of the photoreceptor drum 10 at a speed 1.2 to 2.0 times as high as that of the photoreceptor drum 10. The available linear speed of the photoreceptor drum 10 is 50 to 5000 mm/sec.

The photoreceptor drum 10 consists of conductive base **10*b* and photoreceptor layer 10*a* that covers the conductive base 10*b*** which is grounded.

The numeral 24 is a bias power source that applies bias voltage between the charging roller 22 mentioned above and the conductive base **10*b*, and the charging roller 22 is grounded through the bias power source 24**.

The bias power source 24 is a power source to supply A.C. bias voltage wherein A.C. components are superposed on D.C. components set to the same value as that of voltage used for charging. D is kept within 0.1–5 mm though it depends on the dimension of the distance D between the charging roller 22 and the photoreceptor drum 10 and on charging voltage with which the photoreceptor drum 10 is charged. It was possible to obtain preferable charging conditions by supplying, through protective resistance 28, the A.C. bias voltage wherein A.C. components of 200–3,500 V are superposed, as peak-to-peak voltage ($V_{P\text{-}P}$), on D.C. components of $-500$ V– $-1,000$ V which are mostly the same as voltage for charging. Incidentally, in the bias power source 24, D.C. components are subjected to constant-voltage control, while A.C. components are subjected to constant-current control so that A.C. current $I_{AC}$ is between 20 and 500 $\mu$A/cm.

Numeral 25 is a casing to form a storing section of the magnetic particles. The charging roller 22 and the magnet 23 are disposed in the casing 25. The regulating plate 26 is provided at the outlet of the casing 25, so that the thickness of the magnetic particle layer 21 conveyed by the charging roller 22 can be regulated. A gap formed between the regulating plate 26 and the charging roller 22 is adjusted so that a conveyance amount of the magnetic particles 21, that is, an amount W of the magnetic particles 21 on the charging roller 22 in the developing region can be 10–500 mg/cm$^2$, and preferably 30–150 mg/cm$^2$. The gap formed between the photoreceptor drum 10 and the charging roller 22 is connected by a magnetic brush composed of magnetic particles 21, wherein the thickness of the magnetic brush is regulated.

Numeral 27 is a stirring device, which is a rotational body to correct the deviation of the magnetic particles 21, and the rotational body is composed of a shaft and a plate member capable of being rotated around the shaft. A leveling plate made of insulating resilient material is provided at a position on the upstream side of the charging region so that the layer of the magnetic particles 21 can be pressed against the charging roller 22. The layer of the magnetic particles 21 is leveled at a position immediately before the charging region by the leveling plate made of insulating resilient material such as urethane rubber. Therefore, streak-shaped unevenness harmful for the regulating plate 26 can be avoided, and a uniform thin layer is conveyed to the charging region.

Operations of the charging device 20 described above will be explained as follows.

When the charging roller 22 is rotated in the arrowed direction at the speed ranging from 1.2 times to 2.0 times that of the peripheral speed of the photoreceptor drum 10, while the photoreceptor drum 10 is being rotated in the arrowed direction, layers of magnetic particles 21 attracted by lines of magnetic force of magnetic object 23 to and conveyed by the charging roller 22 are connected magnetically to the shape of a chain to be a sort of brush shape at the location on the charging roller 22 where the charging roller faces the photoreceptor drum, thus the so-called magnetic brush is formed. The magnetic brush is conveyed in the direction of the rotation of the charging roller 22 to come in contact with photoreceptor layer 10*a* on the photoreceptor drum 10 to rub it. Since A.C. bias voltage mentioned above is impressed between the charging roller 22 and the photoreceptor drum 10, charges are injected in the photoreceptor layer 10*a* to charge it through conductive magnetic particles 21. In this case, an alternating electrical field is formed, upon which an A.C. bias is impressed by the A.C. current $I_{AC}$ which is controlled to be constant. Accordingly, in the charging region, the electrical charge injection efficiency of the magnetic brush can be improved, and an amount of generated ozone is small. Therefore, the charging region can be extended, and the electrical charge injection efficiency can be improved, and very stable uniform charging operations can be performed at high speed.

Figure 3:
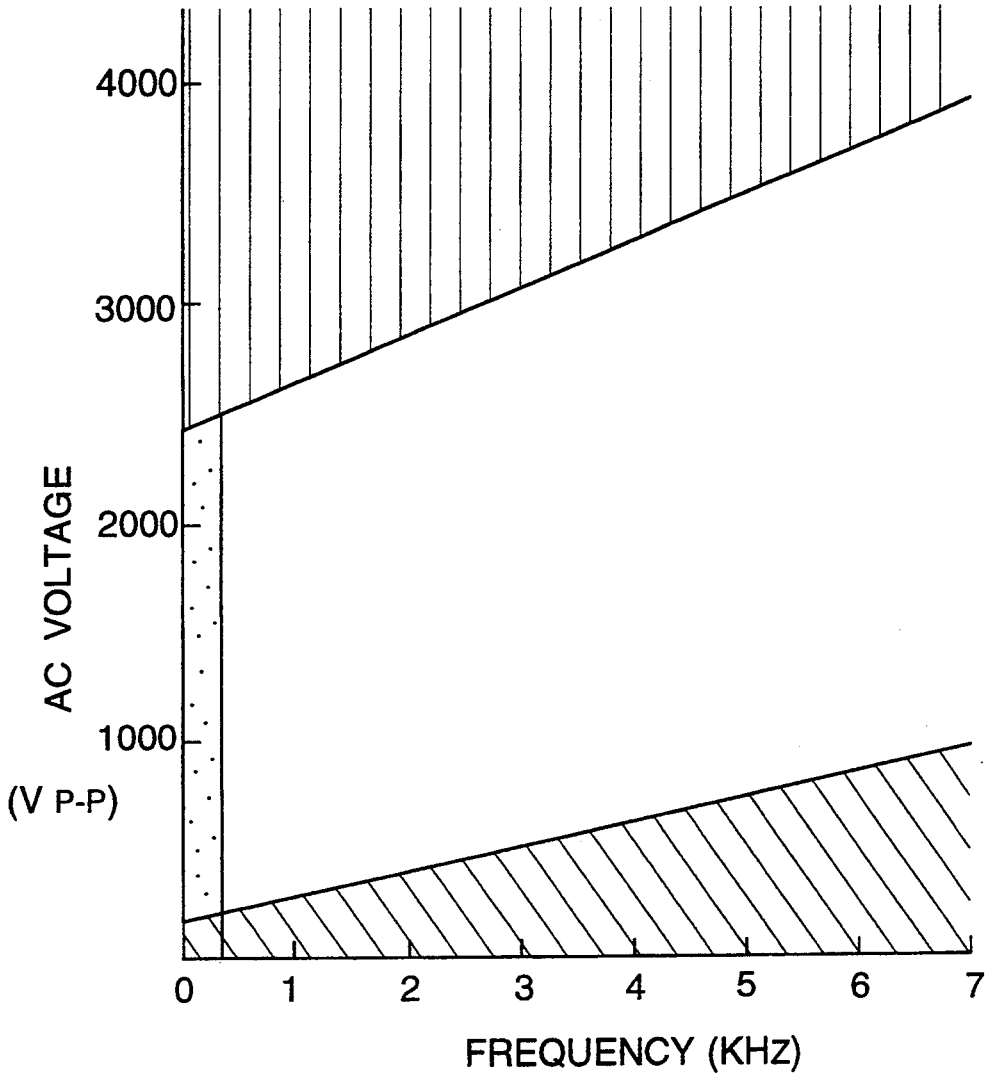
FIG. 3 is a charging characteristic diagram provided when the frequency and voltage of an A.C. voltage component are changed.

Incidentally, FIG. 3 shows the results of the above-mentioned example wherein both frequency and voltage of A.C. voltage components to be impressed on charging roller 22 were varied.

In FIG. 3, a portion hatched with vertical lines represents a zone where dielectric breakdown tends to take place, a portion hatched with slanting lines represents a zone where uneven charging tends to take place, and a portion which is not hatched represents a preferable zone where charging can be conducted stably. As is apparent from the figure, the preferable zone varies slightly depending on variation of A.C. voltage components. Incidentally, a waveform of A.C. voltage component may also be a square wave or a triangular wave, without being limited only to a sine wave. Further, in FIG. 3, a dotted area of low frequency is a zone where uneven charging is caused due to a low frequency.

In this connection, it is further possible to neutralize photoreceptor drum 10 by the use of charging device 20 of the present example. Neutralizing can be carried out by bias voltage wherein only D.C. components are reduced to zero. After forming an image, a photoreceptor is rotated while it is being impressed with only A.C. components, thus, photoreceptor drum 10 can be neutralized.

In this connection, after a long term use, much toner staying on the surface of the photoreceptor drum 10 without being cleaned is mixed in a layer of magnetic particles 21. This sometimes causes the resistance of the magnetic brush 21A to be enhanced, resulting in deteriorated charging efficiency. Due to the foregoing, it is possible to prevent the toner mixing by establishing the conditions under which toner tends to stick to photoreceptor drum 10, including setting to the high level the polarity of D.C. bias voltage to be impressed on charging roller 22 while the photoreceptor drum 10 is rotating before or after image forming, or setting the A.C. voltage to the high level. Especially in the case wherein the charged polarity on the photoreceptor drum 10 is identical to that of toner as in an image forming apparatus conducting reversal development, the polarity is the same as that of toner contained in developing unit 30. Therefore, contamination caused by toner tends not to occur, resulting in no appearance of fog on an image in the course of developing, proving to be an optimum combination.

With regard to a charging roller for the magnetic brush, it is not limited only to the structure of charging roller 22 having therein magnetic object 23, but it may also be one which is composed only of rotary magnetic object 23 without having charging roller 22.

In the first example of the invention, a photoreceptor is charged through a magnetic brush formed on a charging roller that injects charges directly into the photoreceptor. Therefore, the bias voltage can be lowered. When the bias A.C. current is controlled, it is possible to lower bias voltage and thereby to prevent generation of ozone. Further, the deterioration of the magnetic particles is prevented so that the durability can be improved. Accordingly, uniform and stable charging can be performed.

Next, the diameter of the magnetic particles and the condition of the charging roller in the second example will be explained as follows, wherein the same explanation as that of the example 1 is omitted and only different explanation will be made here.

In the second example, a preferable existing amount W of magnetic particles in the charging region is 10 to 300 mg/cm$^2$, and more preferably 30 to 150 mg/cm$^2$. This existing amount of magnetic particles is an average value in the magnetic brush contacting region.

It is preferable that the gap D formed between the charging roller and the photoreceptor is 0.1 to 1 cm. It can be considered that the gap D is a factor to determine the chain length of magnetic particles. Electrical resistance corresponding to the chain length determines the charging ability and the charging speed. On the other hand, it can be considered that W is a factor to determine the density of the chain of magnetic particles. When the number of chains is increased, charging can be uniformly conducted. However, when magnetic particles pass through a narrow gap in the charging region, the chains of magnetic particles are compressed. At this time, the chains of magnetic particles are bent and contacted with each other, and they rub the surface of the photoreceptor while they are subjected to disturbance. In the case where the gap formed between the surface of the charging roller and that of the photoreceptor becomes narrower than 0.1 cm, it is difficult to form bristles of the magnetic brush by which charging can be uniformly conducted, and further a sufficient amount of magnetic particles can not be supplied to the charging area, so that charging can not be stably conducted. In the case where the gap exceeds 1 cm, the magnetic particle layer becomes rough, and the electrical charge injection efficiency is lowered, so that sufficient charging can not be conducted. As described above, when the gap formed between the charging roller and the photoreceptor is not appropriate, the thickness of the magnetic particle layer on the charging roller can not be controlled to an appropriate value. When the gap is maintained in a range of 0.1 to 1 cm, a particle layer of appropriate thickness can be formed, so that unevenness of magnetic particles can be prevented which is caused when the magnetic brush rubs the surface of the photoreceptor.

According to the present invention, when a region is utilized, in which chain-shaped magnetic particles uniformly come into contact with the photoreceptor, uniform charging is conducted. As a result of experiments, it was found that the contact width L of the magnetic brush on the charging roller with the photoreceptor is preferably 0.2 cm$\leqq$L$\leqq$1 cm, and more preferably 0.3 cm$\leqq$L$\leqq$0.7 cm.

This contact width L is determined by the following factors: the gap D formed between the charging roller and the photoreceptor; the gap H formed between the charging roller and the regulating plate to regulate the thickness of the particle layer provided on the charging roller; and the arrangement of magnetic poles in the charging region. In the case of $L<0.2$ cm, charging can not be uniformly conducted, and in the case of $L>1.0$ cm, the A.C. current $I_{AC}$ is increased, so that an amount of generated ozone is increased. Further, the magnetic particles are formed into a brush-shape, so that it tends to clog.

Further, it is preferable that the contact width L and the gap D satisfy the inequality $1 \leqq L/D \leqq 10$.

In the second example, in the charging device by which the photoreceptor is charged, it is preferable that the contact width L of the magnetic brush satisfies the inequality 0.2 cm$\leqq L \leqq$1 cm, and more preferably 0.3 cm$\leqq L \leqq$0.7 cm.

With reference to the attached drawings, the second example of the present invention will be explained as follows.

In the second example, in order to provide excellent charging, the magnetic particles must be perfectly spherical, and the particle size must be 70 μm, and specific resistance must be $10^4\Omega$·cm, and further the triboelectrical charging amount with respect to toner is −5 μC/g when toner concentration is 1%. In FIG. 2, numeral 21 denotes magnetic particles. Numeral 22 is a charging roller to convey the magnetic particles 21, which is made of nonmagnetic and conductive metal such as aluminum. Numeral 23 is a pillar-shaped magnet fixedly provided in the charging roller 22. As shown in the drawing, this magnet 23 is composed of N and S poles disposed on the circumference so that the magnetic intensity can be 500–1000 gauss on the surface of the charging roller 22. A magnetic pole disposed closest to the photoreceptor drum 10 will be referred to as a main magnetic pole, hereinafter. The charging roller 22 is capable of being rotated with respect to the magnet 23. A gap formed between the charging roller 22 and the photoreceptor drum 10 is maintained to be D, and the charging roller 22 is rotated in the same direction as that of the photoreceptor drum 10 at a circumferential speed 1.2 to 2.0 times as high as that of the photoreceptor drum 10. According to the result of the experiment, it was found that the contact width of the magnetic brush formed on the charging roller 22 and the photoreceptor drum 10 was preferably in a range satisfying the inequality 0.2 cm$\leqq L \leqq$1 cm.

According to the result of the experiment, the following was found:

It is preferable that a position of the main pole of the magnet 23, the main magnetic pole being located most closely to the photoreceptor drum 10, is located at a position where the charging roller 22 and the photoreceptor drum 10 are most closely arranged, that is, the main magnetic pole is located close to a center line connecting the center of the photoreceptor drum 10 with that of the charging roller 22, wherein an angle $\theta$ formed between a straight line connecting the center of the charging roller 22 with the main magnetic pole, and the aforementioned center line, is in a range of $-15° \leqq \theta \leqq 15°$.

Numeral 25 is a casing to form a storing section of the magnetic particles. The charging roller 22 and the magnet 23 are disposed in the casing 25. The regulating plate 26 is provided at the outlet of the casing 25, so that the thickness of the magnetic particle layer 21 conveyed by the charging roller 22 can be regulated. A gap H formed between the regulating plate 26 and the charging roller 22 is smaller than the gap D formed between the charging roller 22 and the photoreceptor drum 10, so that the equation of H=D—(100 to 400 μm) can be maintained, and the contact width L of the magnetic brush in the charging region is adjusted to maintain the inequality of 0.2 cm$\leqq L \leqq$1 cm, and also the gap D formed between the charging roller 22 and the photoreceptor drum 10 is maintained in the range of 0.1 cm$\leqq D \leqq$1 cm.

In the case where the contact width L is adjusted and set, the smaller the diameter of the charging roller is, the easier the contact width L can be adjusted and set. The gap D formed between the charging roller 22 and the photoreceptor drum 10 is the smallest at a position on a center line connecting the center of the charging roller 22 and that of the photoreceptor drum 10. The gap is extended at positions in the upstream or the downstream with respect to the aforementioned position on the center line. When the diameter of the charging roller 22 is small, the gap is suddenly extended, which makes a boundary between the contact portion and the noncontact portion clear in the case where the contact width L of the magnetic brush is set, and is effective to prevent uneven charging and deposition of carrier. According to the result of an experiment, the diameter "a" of the charging roller 22 is preferably in the range of 5 mm$\leqq a \leqq$20 mm. When the diameter "a" exceeds 20 mm, a redundant contact region is extended, so that the charging current is increased. When the diameter "a" is not more than 5 mm, it is difficult to provide the aforementioned contact width of 0.2 cm$\leqq L \leqq$1 cm, and further the magnetic brush does not come into contact with the photoreceptor drum in a dense condition. Therefore, uniform charging can not be performed even when the contact width L satisfies the condition.

In the same manner as the first example, in the second example, whereas the A.C. bias voltage is impressed between the charging roller 22 and the photoreceptor drum 10, an electrical charge is injected onto the photosensitive layer 10*a* through the conductive magnetic particles 21, so that the photoreceptor drum 10 is charged. In this case, when an A.C. bias is impressed by the A.C. current $I_{AC}$ which has been subjected to constant current control, an alternating electrical field is formed, and an electrical charge is stably and uniformly charged by the magnetic brush in which the magnetic particles 21 are connected in the form of a chain, in a region where the magnetic brush is uniformly provided (a region of the contact width L). In this case, an amount of generated ozone is very small, and very stable and uniform charging can be conducted. The stirring plate 27 is a rotational body including a shaft and a plate-shaped member to correct the deviation of the magnetic particles.

In the second example, neutralization can be executed when only a D.C. component of the bias voltage is made to be zero. After the formation of an image, the photoreceptor drum 10 is neutralized when only an A.C. component is impressed while the photoreceptor is being rotated. At a point of time when the photoreceptor drum 10 has been neutralized, impression of the A.C. component is also stopped, and then the magnetic pole of the magnet 23 is rotated so that the N-S direction of the magnet can be parallel with a tangent of the photoreceptor drum 10 at a position where the photoreceptor drum is opposed to the charging roller. Then, by the action of the horizontal magnetic field, the bristles of the magnetic brush becomes parallel with the tangent of the photoreceptor drum 10. Therefore, a tip of the magnetic brush can be separated from the surface of the photoreceptor drum 10 without the deposition of magnetic particles 21 onto the circumferential surface of the photoreceptor drum 10.

According to the second example of the present invention, an electrical charge is directly injected into the photoreceptor through the magnetic brush formed on the charging roller. Accordingly, the bias voltage can be lowered, and when the bias A.C. current is subjected to constant current control so that the current can be controlled in a predetermined range, an amount of generated ozone is reduced, and the deterioration of magnetic particles can be prevented, so that high durability can be provided. When the contact width of the magnetic brush with the photoreceptor is restricted in a predetermined range so as to specify the charging region, charging is performed in a region where the magnetic brush is uniform. Therefore, the charging region is extended. Further, the magnetic particle chains are not directly directed to the photoreceptor. Accordingly, the occurrence of dielectric breakdown of the photoreceptor can be prevented, and uniform and stable charging can be conducted in the image forming apparatus.

Next, the third example will be explained as follows. The same description as that of the first example is omitted here. With reference to FIG. 2, the third example is described. It is preferable that the gap D between the rotational member and the photoreceptor is not less than 0.02 cm and not more than 0.5 cm at a position where the rotational member and the photoreceptor are most closely located. When the gap D between the rotational member and the photoreceptor is smaller than 0.02 cm, it difficult to form bristles of the magnetic brush by which uniform charging can be performed, and further a sufficient amount of magnetic particles can not be supplied to the charging area, so that charging can not be stably performed. In the case where the gap D exceeds 0.1 cm, the magnetic particle layer becomes rough, and charging can not be performed uniformly, and further the electrical charge injection effect is lowered and sufficient charging can not be performed. As described above, when the gap D is not appropriately set, the thickness of magnetic particles on the rotational member can not be appropriately adjusted. When the gap is maintained in a range of 0.02 to 0.5 cm, the thickness of the magnetic particle layer can be appropriately maintained, and the occurrence of rough surface can be avoided when the magnetic brush rubs the photoreceptor drum surface.

The inventors have found that the most preferable condition exists between the conveyance amount (W) and the gap (D).

D is considered to be a factor to determine the length of the magnetic particle chain. The electrical resistance determined by the chain length corresponds to the easiness and charging speed. On the other hand, W is considered to be a factor to determine the density of magnetic particle chains. When the number of chains is increased, the uniformity of charging can be improved. However, when the magnetic particles pass through a narrow gap in the charging region, the magnetic particle chains are compressed, and the magnetic particle chains are contacted with each other and bent and disturbed. Under the above condition, the magnetic particle chains rub the circumferential surface of the photoreceptor.

In the third example, excellent charging can be performed when a relative speed between the charging roller and the photoreceptor is regulated and also when the relative volume ratio Q corresponding to the relative magnetic particle density is regulated.

The relative volume ratio Q (%) is defined by the following equation in the charging region.

$$Q=(W/D)\times(1/\rho)\times 100$$

where W is a conveyance amount, that is, an amount ($g/cm^2$) of magnetic particles existing in a unit area on the rotational member, D is a gap (cm) formed between the rotational member and the photoreceptor, and $\rho$ is specific gravity ($g/cm^3$) of magnetic particles.

When the value of Q is small, the magnetic particle chains are rough, and they are less disturbed, so that charging can not be uniformly conducted. When the value of Q is large, the magnetic particle chains are not sufficiently formed due to high packing, so that the magnetic particles are less disturbed, which obstructs the movement of an electrical charge, so that uniform charging can not be performed. According to the result of experiments made by the inventors, uniform charging characteristics can be provided under the condition of $20 \leqq Q \leqq 40\%$.

That is, when the value of Q is small, dense bristles 21A of the magnetic brush can not be sufficiently formed, so that charging can not be completely conducted, and uneven charging takes place. When the value of Q is larger than 40, the magnetic particles are compressed and stay upstream of the charging region. As a result, an over current occurs, and ozone tends to be generated. Further, the charging region is unnecessarily extended, and the magnetic particles are deposited on the surface of the photoreceptor.

Accordingly, when consideration is given to the gap D formed between the charging roller and the photoreceptor at a position where the charging roller and the photoreceptor are most closely located, it has been found that the most preferable value of D is 0.02 to 0.5 cm. As a result of an investigation made by the inventors, the most preferable range of $Q\times D$ is $0.4 \leqq Q\times D \leqq 20$ cm.

In FIG. 2, the charging roller 22 can be rotated with respect to the magnet 23. A gap formed between the charging roller 22 and the photoreceptor drum 10 is maintained to be 0.02 to 0.5 cm, and the charging roller 22 is rotated in the same direction as that of the photoreceptor drum 10 at a circumferential speed 1.2 to 2.0 times as high as that of the photoreceptor drum 10.

According to the result of the experiment, the following was found:

It is preferable that a position of the pole **23*a* of the magnet 23, the magnetic pole being located most closely to the photoreceptor drum 10, is located at a position where the charging roller 22 and the photoreceptor drum 10 are most closely arranged, that is, the main magnetic pole is located close to a center line connecting the center of the photoreceptor drum 10 with that of the charging roller 22, wherein an angle $\theta$ formed between a straight line connecting the center of the charging roller 22 with the magnetic pole 23*a***, and the aforementioned center line, is in a range of $-15° \leqq \theta \leqq 15°$. In this case, it is not necessary to limit the polarity of the magnetic pole to N or S.

The bias power source 24 supplies an A.C. bias voltage in which an A.C. component is superimposed on a D.C. component that has been set at the same voltage as that to be charged. In this case, the D.C. component is subjected to constant voltage control, and the A.C. component is subjected to constant current control. A preferable alternating electrical field was formed under the following condition although it depended upon a gap formed between the charging roller 22 and the photoreceptor drum 10, and a charging voltage of the photoreceptor drum 10.

In the case where the gap D was held in a range of 0.02 to 0.1 cm, an A.C. component, the peak-to-peak voltage ($V_p$—$V_p$) of which was 200 to 3500 V, was superimposed on a D.C. component of −500 to −1000 V which was approximately the same as a voltage to be charged. Then, the A.C. bias voltage was impressed through the protective resistance 28.

Figure 4:
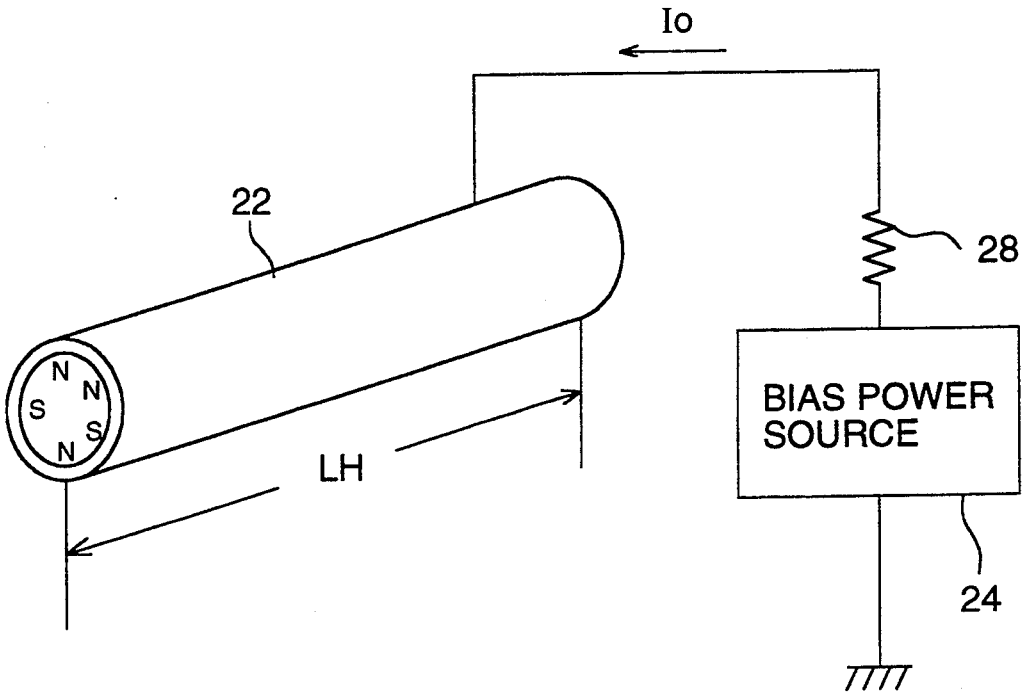
FIG. 4 is a perspective view showing a charging roller of the charging apparatus shown in FIG. 1.
Figure 5:
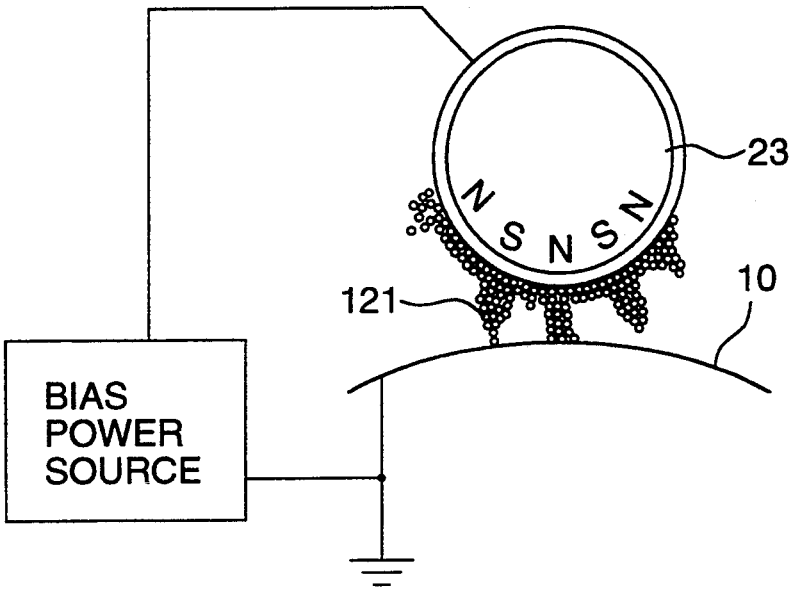
FIG. 5 PRIOR ART
FIGS. 5, 6 and 7 are enlarged sectional views showing a charging region in a charging device of the prior art.
Figure 6:
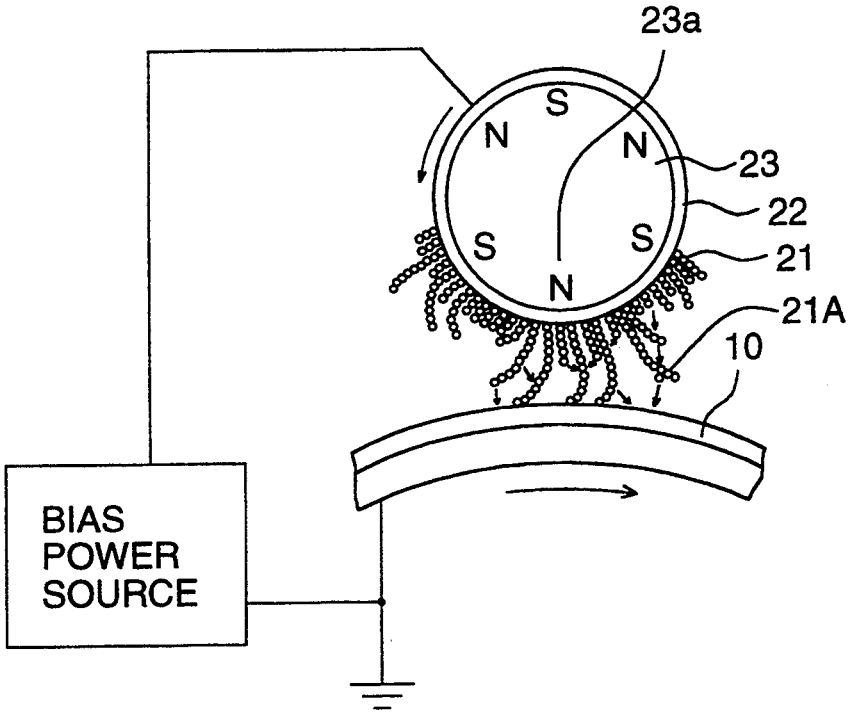
FIG. 6 PRIOR ART
Figure 7:
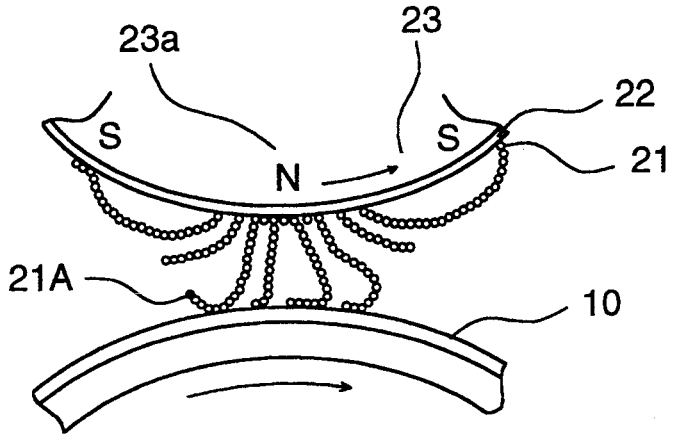
FIG. 7 PRIOR ART

A preferable result was provided under the following condition:

When the contact length between the charging roller 22 and the photoreceptor drum 10 was LH cm, and an overall current of the A.C. component was $I_0$ (shown in FIG. 4), a current $I_{AC}$ per unit contact length was $I_0$/LH, and the value of $I_0$/LH was set at a value satisfying the inequality of $20 \leqq I_{AC} \leqq 500$ (μA/cm). When the current $I_{AC}$ was 20 (μA/cm), charging was not uniformly performed, and when $I_{AC}$ exceeded 500 (μA/cm), ozone was generated.

A gap formed between the regulating plate 26 and the charging roller 22 is adjusted so that a relative volume ratio Q of the magnetic particles 21 on the charging roller 22 in the charging region can be in a range of $20 \leqq Q \leqq 40\%$. The photoreceptor 10 and the charging roller 22 are electrically connected through a magnetic brush of the magnetic particles 21 provided in a gap formed between the photoreceptor 10 and the charging roller 22. Numeral 27 is a stirring device, which is a rotational body to correct the deviation of the magnetic particles 21, and the rotational body is composed of a shaft and a plate member capable of being rotated around the shaft.

Next, the operation of the charging device 20 will be explained as follows. In the same manner as the first example, in the third example, whereas the A.C. bias voltage is impressed between the charging roller 22 and the photoreceptor drum 10, an electrical charge is injected onto the photosensitive layer 10*a* through the conductive magnetic particles 21 through the bristles 21A, so that the photoreceptor drum 10 can be charged. In this case, when an A.C. bias is impressed by the A.C. current $I_{AC}$ which has been subjected to constant current control, an alternating electrical field is formed, and a product of the relative volume ratio Q and the gap $D_{sd}$ in the charging region is regulated. Therefore, the bristles 21A of the magnetic brush in which magnetic particles 21 are connected in a chain-shape uniformly and properly come into contact with the circumferential surface of the photoreceptor drum 10, so that electrical charges are properly injected by the magnetic brush, and stable and uniform charging can be efficiently performed at high speed.

In the third example, the magnetic particles 21 are spherical ferrite particles subjected to conductive coating. Alternatively, the magnetic particles 21 are provided in the following manner: after magnetic particles and resin have been thermally kneaded, they are smashed to provide conductive magnetic particles. In order to electrically charge the magnetic particles in a good condition, the particles are accurately spherical, and the diameter is 50 μm, and the specific resistance is $10^8 \Omega \cdot$cm. The triboelectrical charging amount of the particles with respect to toner is −5 μC/g when toner concentration is 1%.

As explained before, according to the third example of the present invention, electrical charges are directly injected onto the photoreceptor through the magnetic brush formed on the rotational member, and the electrical current $I_{AC}$ of the A.C. component of the bias voltage per unit length is regulated to be in a range of $20 \leqq I_{AC} \leqq 500$ (μA/cm). Accordingly, the generation of ozone is prevented so that the durability of magnetic particles can be improved. Further, the relative volume ratio Q of the magnetic particles on the rotational member is regulated to be in a range of $20 \leqq Q \leqq 40\%$ in the charging area. Therefore, the density of bristles of the magnetic brush becomes appropriate in the charging region, and the magnetic brush uniformly comes into contact with the photoreceptor so that stable and uniform charging can be conducted in the image forming apparatus.

What is claimed is:

1. An image forming apparatus for developing a latent image on a photoreceptor with toner, comprising:
- sleeve means for charging the photoreceptor;
- magnetic particles for forming a magnetic brush on a surface of said sleeve means;
- driving means for moving said magnetic brush; and
- power applying means for applying an alternating current between 20 and 500 μA/cm onto a charging area between said sleeve means and said photoreceptor;
- wherein said sleeve means is located in a vicinity of said photoreceptor so that said magnetic brush is in contact with a surface of said photoreceptor.

2. The apparatus of claim 1, wherein a contacting length L(cm) of said magnetic brush onto said surface of said photoreceptor satisfies:

$$0.2 \text{ cm} \leqq L \leqq 1 \text{ cm}.$$

3. The apparatus of claim 2, wherein said contacting length L(cm) and a gap D(cm), formed between said sleeve means and said photoreceptor, satisfy:

$$1 \leqq L/D \leqq 10.$$

4. The apparatus of claim 1, wherein an amount W of said magnetic particles in said charging area is between 10 and 500 mg/cm$^2$.

5. The apparatus of claim 4, wherein said amount W(mg/cm$^2$) and a gap D(cm), formed between said sleeve means and said photoreceptor, satisfy:

$$300 \leqq W/D \leqq 3000 \text{ mg/cm}^3.$$

6. The apparatus of claim 5, wherein a contacting Length L(cm) of said magnetic brush onto said surface of said photoreceptor satisfies:

$$0.2 \text{ cm} \leqq L \leqq 1 \text{ cm}.$$

7. The apparatus of claim 1, wherein a relative volume ratio Q of said magnetic particles in said charging area is between 20 and 40%.

8. The apparatus of claim 7, wherein said relative volume ratio Q and a gap D (cm), formed between said sleeve means and said photoreceptor, satisfy:

$$0.4 \leqq Q \times D \leqq 20.$$

9. The apparatus of claim 8, wherein a contacting Length L(cm) of said magnetic brush onto said surface of said photoreceptor satisfies:

$$0.2 \text{ cm} \leqq L \leqq 1 \text{ cm}.$$

* * * * *